US006267473B1

(12) United States Patent
Smith

(10) Patent No.: US 6,267,473 B1
(45) Date of Patent: Jul. 31, 2001

(54) CHECK VALVE IN AN INK PUMP FOR AN INK-JET PRINTER

(75) Inventor: Mark A Smith, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/302,569

(22) Filed: Apr. 30, 1999

(51) Int. Cl.[7] ..... B41J 2/175
(52) U.S. Cl. ..... 347/85
(58) Field of Search ..... 347/85, 86, 87; 137/854, 852

(56) References Cited

U.S. PATENT DOCUMENTS 4,712,574 * 12/1987 Perrott ..... 137/854

OTHER PUBLICATIONS

Resenex High–Flow Check Valves Catalog # R701 Catalog # R702 Rev. 11/94.

VernayUmbrella Check Valves (Brochure) Vernay Laboratories, Inc. 1995 VUM–0995.

Vernay Duckbill Check Valves (Brochure) Vernay Laboratories, Inc. 1995 VAB–0995.

* cited by examiner

*Primary Examiner*—N. Le
*Assistant Examiner*—Judy Nguyen

(57) ABSTRACT

A check valve for an ink pump for an ink jet printer. The check valve is exposed to a pressure, P1, on one side and a pressure, P2, on the other side. The check valve opens when P1 is greater than P2. The check valve shuts when P1 is less than P2. The check valve has a circular valve seat; a resiliently deformable, circular valve disk; and a centrally disposed cylindrical pin. The pin axially symmetrically locates the valve disk with respect to valve seat. The pin also has an annular seat disposed so that a fluid tight longitudinal seal is formed between the valve disk and the annular seat. The annular seat also supports the valve disk against the pressure, P2.

2 Claims, 2 Drawing Sheets

CHECK VALVE IN AN INK PUMP FOR AN INK-JET PRINTER

FIELD OF INVENTION

The present invention generally relates to ink-jet printers and, more particularly, to the apparatus and methods for transporting the ink used by such printers from an ink reservoir to an inkjet print head.

BACKGROUND OF THE INVENTION

Check valves or their equivalents have been probably known since the development of the first fluid displacement pumps. Moreover, ink-jet printers have been commercially available since at least the late 1980's, and their general construction is also well known, being the subject of numerous patents world-wide.

Nevertheless, developing a simple, low cost, dependable check valve for the ink pumps used in these printers has proven to be a difficult task. One problem has been to develop a check valve that is as insensitive as possible to any strain that develops during manufacture and thereafter. Such strain can cause the check valve to fail to close and to permit the back flow of ink out of the pump chamber, resulting first in the loss of pump efficiency and ultimately in the failure of the check valve to function. Such strain can be caused by numerous factors including an externally applied mechanical load, mechanical interference, chemical attack by the ink causing either shrinkage or swelling, thermal excursion, and continued polymer crystallization after fabrication.

Other problems include check valves opening too slowly or not sufficiently enough so the pump chamber fills too slowly with ink, causing the speed of the printer to diminish and printing through-put to become hampered. Another problem has been designing a check valve that can be pre-loaded shut against its valve seat so that the check valve is insensitive to the actuation speed of the pump. The preload is achieved by axially deforming the center portion of an inexpensive, die cut disk which costs an order of magnitude less than a thermoset part with three dimensional detail derived from compression molding or similar processes.

It will be apparent from the foregoing that although there are many processes and apparatus for transporting ink in ink-jet printers, there is still a need for a check valve in an ink pump that is dependable, low cost, and simple in design.

SUMMARY OF THE INVENTION

Briefly and in general terms, a check valve according to the invention includes a circular valve seat; a resiliently deformable, circular valve disk; and means for axially symmetrically mounting the valve disk with respect to the valve seat.

The check valve disclosed herein solves virtually all of the problems discussed above. Because the design calls for only two parts and the valve disk has detail in only two dimensions, this check valve has low part and assembly costs and is reliable, dependable, robust and simple in design. Its fundamental axial symmetry, the support of the valve disk at a single, fixed point, and use of a central mounting pin make it inherently tolerant to all sources of strain. Also, the design of the check valve exposes a large area to the forward flow of ink which in turn allows the pump chamber to fill more rapidly with ink during operation. Since the valve disk can be pre-loaded shut against its valve seat, the check valve does not have to be shut by pressure from the ink pump, and, thus, the check valve is insensitive to pump actuation speed. Moreover, the valve disk is fabricated from EPDM butyl rubber and the valve seat, from polyethylene so the check valve is thermally stable and is not chemically attacked by the ink used in the printer.

A further feature of this check valve is its low cracking pressure. Cracking pressure is the minimum pressure at which there is non-zero fluid flow through a valve. In check valves that were actually fabricated, the range of cracking pressure was between about 10" and about 2" of water column, a negative pressure.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
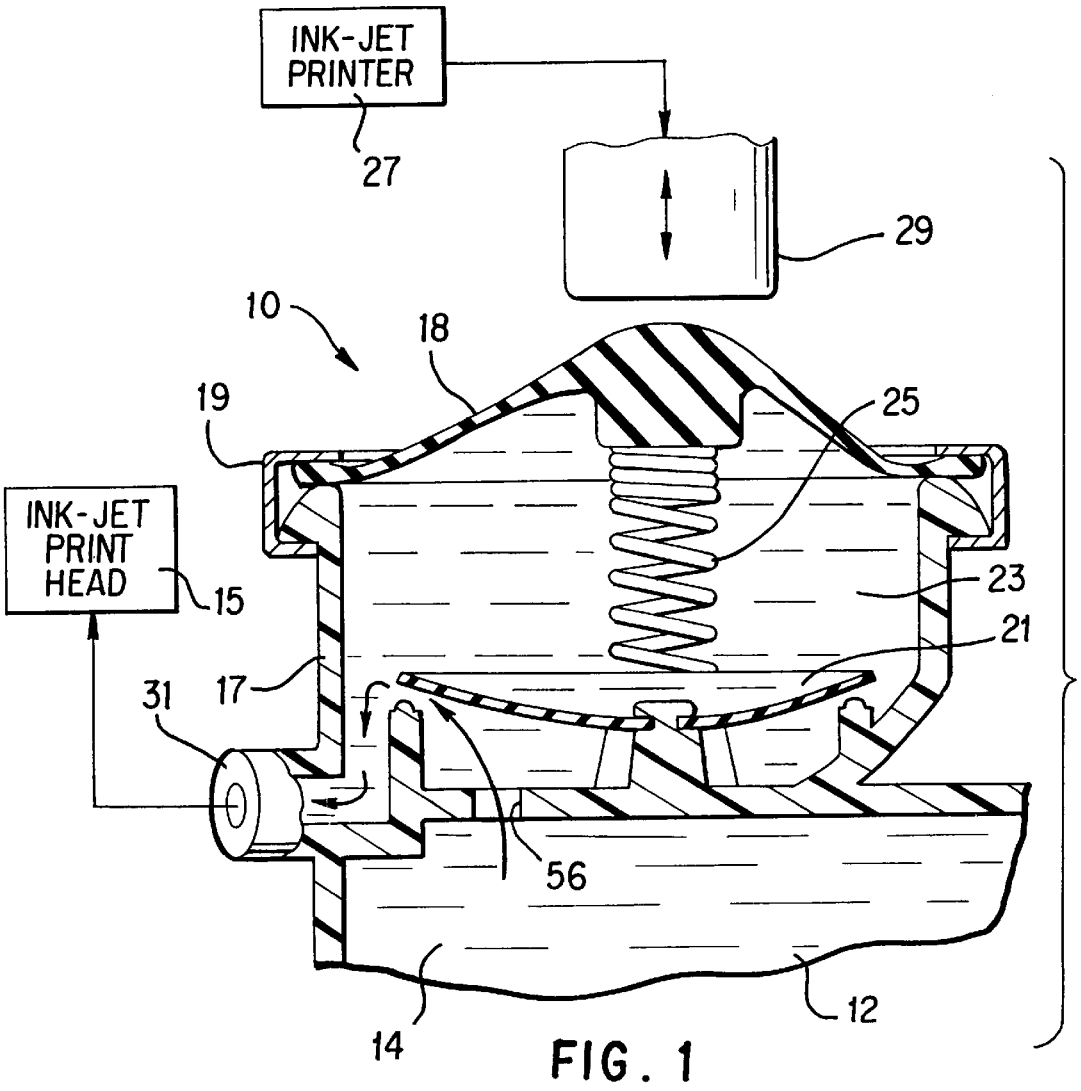
FIG. 1 is a side elevational view, in section, partially broken away and partially diagrammatic, of a check valve for an ink pump embodying the principles of the invention.

As shown in the drawings for the purposes of illustration, the invention is embodied in a check valve having a circular valve seat; a resiliently deformable, circular valve disk; and means for axially symmetrically mounting the valve disk with respect to the valve seat.

Referring to FIG. 1, reference numeral 10 generally indicates an ink pump in an ink-jet printer. The ink pump 10 transfers ink 12 from an ink reservoir 14 to an ink-jet print head 15. The ink reservoir is an ink bag fabricated from a flexible film.

The ink pump 10, FIG. 1 includes a pump housing 17, an elastomeric diaphragm 18, a crimp ring 19, and a check valve 21. The pump housing is generally cylindrical and its side wall is joined to the diaphragm 18 by the crimp ring 19. The pump housing, the diaphragm 18, and the check valve 21 together form a pump chamber 23 where the ink is pressurized by the pump 10. The pump housing is fabricated from injected molded polyethylene, the diaphragm from EPDM butyl rubber, and the crimp ring from aluminum. The diaphragm 18 is urged upward into a concave shape by a pump return spring 25. The return spring is retained by the bottom wall of the pump housing 17 behind the check valve 21.

Figure 2:
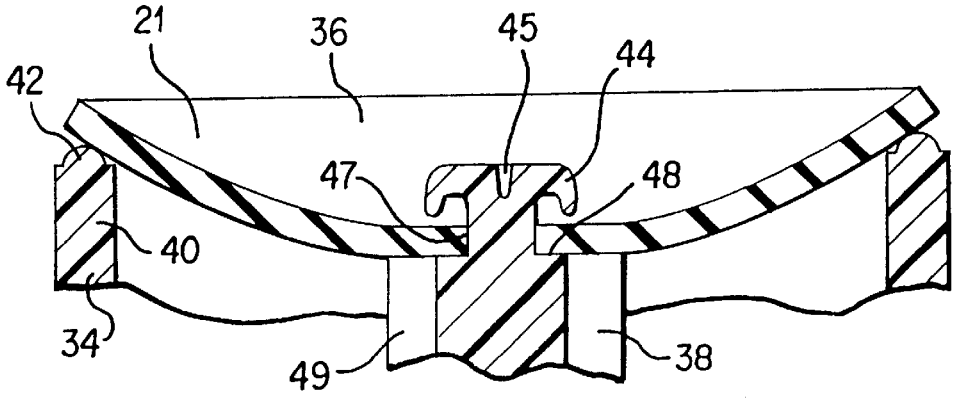
FIG. 2 is a side elevational view, in section and partially broken away of the check valve of FIG. 1.
Figure 3:
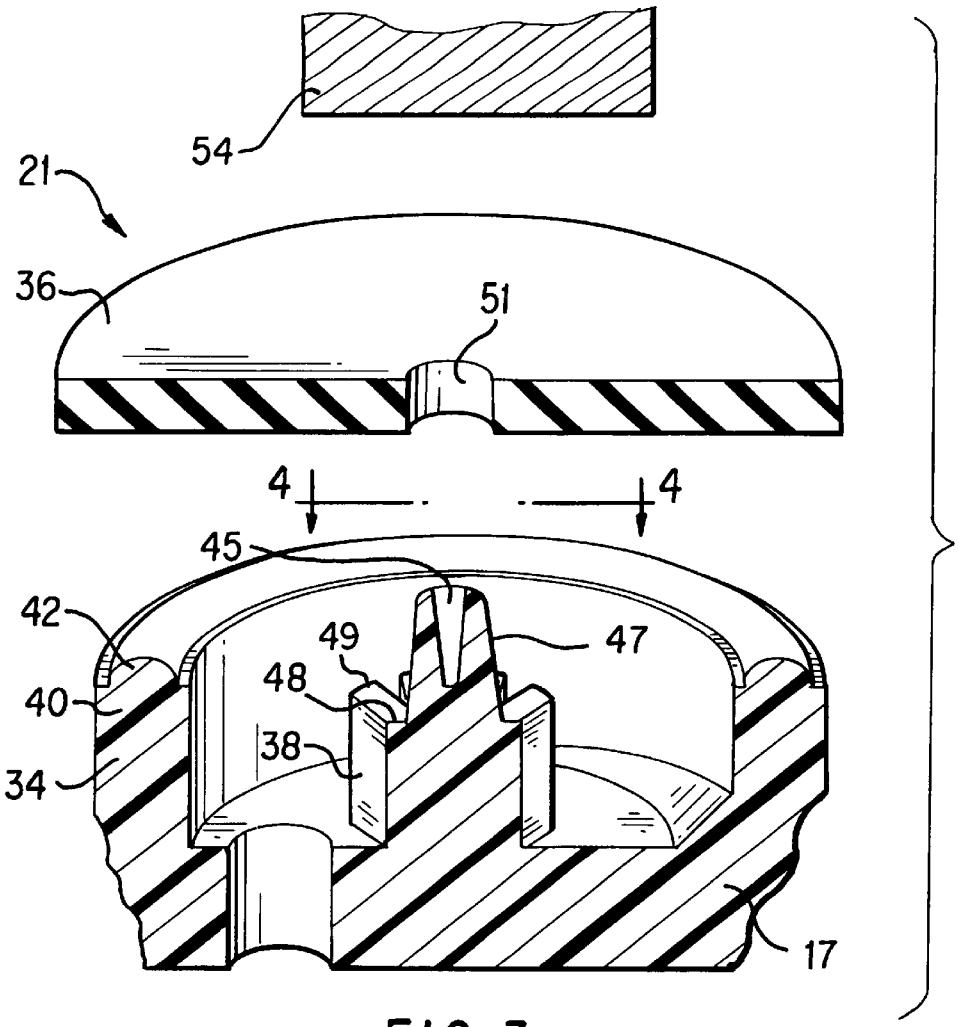
FIG. 3 is a side elevational view, in section and exploded, of the check valve of FIG. 1.

Referring to FIGS. 2 and 3, the check valve 21 includes a valve seat 34, a valve disk 36, and a pin 38. The valve seat 34 is cylindrical and is formed in the bottom wall of the pump housing 17. The valve seat has a circular side wall 40 that is surmounted by a sealing surface 42 having a semi-circular cross section. The sealing surface is polished and has the semi-circular cross section to accommodate any flexure, deformation, or rolling of the valve disk 36. In other words, the semi-circular cross section provides different contact angles for the valve disk 36 and the disk gently rolls over the sealing surface 42 in response to changes in pressure within the pump.

Figure 4:
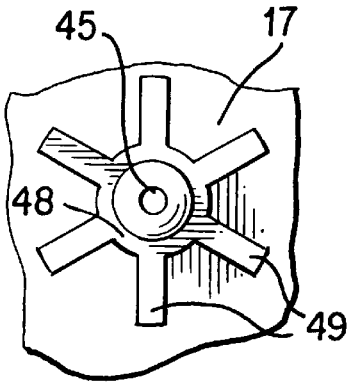
FIG. 4 is a top plan view, broken away, taken along line 4—4 of FIG. 3 of the check valve of FIG. 1.

Referring to FIGS. 2, 3, and 4 the pin 38 in the check valve 21 axially symmetrically mounts the valve disk 36 with respect to the valve seat 34 at a single point. The pin 38 has a flared out free end 44 that retains the valve disk 36 in place in case of severe over pressure in the ink reservoir 14, FIG. 1. The free end is formed by heat staking the cored portion 45, FIG. 3 of the pin during the assembly process. The pin also includes a disk retaining portion 47 and an annular ledge or seat 48. The planer surface of the valve disk 36 abuts against this annular ledge after assembly. The pin 38 also includes six webs 49 that further support the valve disk 36 after assembly. The upper ends of the webs 49 form a common plane with the annular seat 48 as best illustrated in FIGS. 2 and 3 and like the annular seat support the valve disk 36. The webs 49 also establish the amount of preloaded pressure exerted by the valve disk 36 on the sealing surface 42, FIG. 2.

The valve disk 36, FIGS. 2 and 3, is cylindrical, generally of uniform thickness, flexible, resiliently deformable, and fabricated from EPDM butyl rubber. The outside diameter of the valve disk is larger than the diameter of the sealing surface 42 of the valve seat 34, FIG. 2. The disk further has a concentric, centrally located opening 51 that has an inside diameter (ID) that is substantially smaller than the outside diameter (OD) of the disk retaining portion 47 of the pin 38. During assembly the valve disk is pressed onto the pin 38. The valve disk 36 is sealed at the pin 38 in two ways. The ID of the opening 51 is smaller than the OD of the abutting portion 47 of the pin, thereby developing a passive radial seal at the point of contact. Secondly, the upper ends of the webs 49 and the annular seat 48 on the pin 38 form a common supporting surface for the bottom side of the valve disk 36, which is an axial or longitudinal seal that is self-energizing. The effect of the axial seal increases as the pressure in the pump chamber 23, FIG. 1 increases.

Referring to FIG. 2, the valve disk 36 is normally urged against the sealing surface 42 of the valve seat 34. The amount of preloaded shutting pressure exerted against the sealing surface by the valve disk is determined by the relative location of the surface formed by the upper ends of the webs 49 and the annular seat 48 on the pin 38 and the contact surface of the sealing surface 42. The dual pin/valve disk sealing arrangement described above holds the valve disk in place.

FIG. 3 illustrates the assembly process of the check valve. The valve disk 36 is pressed over the free end of the pin 38 to the position illustrated in FIG. 2. Thereafter a heat stake tip 54, FIG. 3 applies heat and pressure to the free end of the pin, causing the cored portion 45 of the pin to flare outward as indicated by reference numeral 44, FIG. 2.

The ink pump 10, FIG. 1 is actuated by an ink-jet printer 27 through a series of cams, not shown, that cause a mechanical actuator 29 to move with reciprocal motion and intermittently engage the top surface of the diaphragm 18. More specifically, the actuator 29 moves downward, overcomes the upward urging of the pump return spring 25, forces the diaphragm 18 downward, and thereby pressurizes the pump chamber 23. The now pressurized ink flows out of the pump chamber 23, through an outlet 31, and onto the ink-jet print head 15. Thereafter, the actuator 29 moves upward and off of the diaphragm 18. The pump return spring 25 urges the diaphragm upward to its normal concave shape and the pressure in the pump chamber 23 decreases, causing the check valve 21 to crack and open. Ink now flows out of the ink reservoir 14, through the port 56 in the ink pump 10, between the underside of the valve disk 36 and the sealing surface 42 of the valve seat 34, and into the pump chamber 23. Between pump cycles the actuator 29 is fully withdrawn upward and out of contact with the diaphragm 18 and all pressure in the ink pump and reservoir is released.

Figure 5:
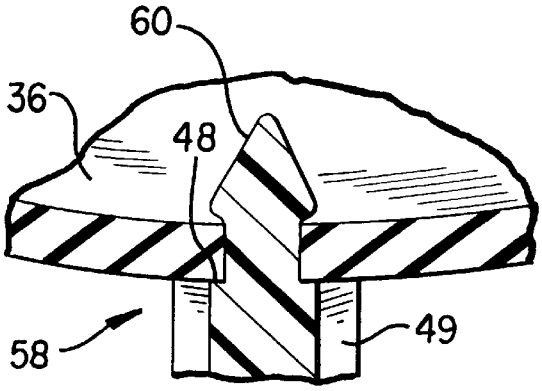
FIG. 5 is a side elevational view, in section and broken away, of an alternative check valve for an ink pump embodying the principles of the invention.

Reference numeral 58, FIG. 5 generally indicates an alternative pin that is formed by injection molding when the pump housing 17, FIG. 1 is formed. The pin 58 has a generally cone shaped free end 60 that helps locate the opening 51 in the valve disk 36 during assembly. The pin has an annular seat 48 and webs 49 that are fabricated and function in the same manner as the pin 38. During assembly, the valve disk 36 is forced over the cone shaped free end 60 and snaps into position. The dual pin/valve sealing system described above is provided for pin 58 as well. The pin 58 is not heat staked.

Although specific embodiments of the invention have been described and illustrated, the invention is not to be limited to the specific forms or arrangement of parts so described and illustrated. The invention is limited only by the claims.

I claim:

1. A check valve exposed to a pressure, P1, on one side and a pressure, P2, on the other side, the check valve opens when P1 is greater than P2 plus any preloaded shutting pressure on the valve, the check valve shuts when P1 is less than P2 plus any preloaded shutting pressure on the valve, comprising:

a circular valve seat;

a resiliently deformable, circular, cylindrical valve disk;

a centrally disposed, cylindrical pin connected to both the valve seat and the disk for axially symmetrically locating the circular valve disk with respect to the circular valve seat, said valve disk being mounted on said pin; and an annular seat on said pin disposed such that a fluid tight longitudinal seal is formed between the valve disk and the annular seat, said annular seat supports the valve disk against the pressure P2.

2. The check valve of claim 1 wherein the longitudinal seal has a sealing effect that increases as P2 increases.

* * * * *